US010725491B2

(12) United States Patent
Collins

(10) Patent No.: US 10,725,491 B2
(45) Date of Patent: Jul. 28, 2020

(54) METHODS AND APPARATUS TO CORRECT GATE BIAS FOR A DIODE-CONNECTED TRANSISTOR

(71) Applicant: Texas Instruments Incorporated, Dallas, TX (US)

(72) Inventor: Gregory Wallis Collins, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 16/449,079

(22) Filed: Jun. 21, 2019

(65) Prior Publication Data

US 2020/0183438 A1 Jun. 11, 2020

Related U.S. Application Data

(60) Provisional application No. 62/775,656, filed on Dec. 5, 2018.

(51) Int. Cl.
*G05F 3/02* (2006.01)
*G05F 3/26* (2006.01)

(52) U.S. Cl.
CPC ..... *G05F 3/262* (2013.01)

(58) Field of Classification Search
CPC ..... G05F 3/262; G05F 3/265; G05F 3/267; G05F 3/30; G05F 3/242; G05F 1/465
See application file for complete search history.

(56) References Cited

U.S. PATENT DOCUMENTS 4,398,160 A 8/1983 Neidorff
5,369,354 A * 11/1994 Mori ..... G05F 3/24 323/313
5,712,556 A * 1/1998 Okamura ..... G05F 3/242 323/314

* cited by examiner

*Primary Examiner* — Long Nguyen
(74) *Attorney, Agent, or Firm* — Lawrence J. Bassuk; Charles A. Brill; Frank D. Cimino

(57) ABSTRACT

Methods, systems, and apparatus to correct gate bias for a diode-connected transistor are disclosed. An example apparatus includes a first resistor including a first resistor terminal and a second resistor terminal; a second resistor including a first resistor terminal and a second resistor terminal; a first transistor including a current terminal and a gate terminal, the current terminal of the first transistor coupled to the first resistor terminal of the first resistor and the gate terminal of the first transistor is coupled to the second resistor terminal of the first resistor; and a second transistor including a first current terminal and a second current terminal, the first current terminal of the second transistor coupled to the gate terminal of the first transistor, and the second current terminal of the second transistor coupled the first current terminal of the second resistor.

15 Claims, 5 Drawing Sheets

| | V_IN>V_OUT+Vt | V_IN<V_OUT+Vt |
|---|---|---|
| M1 | ON | OFF |
| M2 | OFF | OFF |

| | V_IN>V_OUT | V_IN<V_OUT |
|---|---|---|
| M1 | ON | OFF |
| M2 | ON | ON |

METHODS AND APPARATUS TO CORRECT GATE BIAS FOR A DIODE-CONNECTED TRANSISTOR

RELATED APPLICATION

This patent claims the benefit of U.S. Provisional Patent Application Ser. No. 62/775,656, which was filed on Dec. 5, 2018. U.S. Provisional Patent Application Ser. No. 62/775,656 is hereby incorporated herein by reference in its entirety.

FIELD OF THE DISCLOSURE

This disclosure relates generally to transistors and, more particularly, to methods and apparatus to correct gate bias for a diode-connected transistor.

BACKGROUND

Transistors, such as metal oxide semiconductor field effect transistors (MOSFETs), can be used as switches. Such a MOSFET can be turned on (e.g., enabled) and turned off (e.g., disabled) based on the voltage applied to a gate terminal of the MOSFET. In some examples, the terminals of a MOSFET may be connected to leverage the switching operation of the MOSFET to cause the MOSFET to act as a diode (e.g., by coupling a drain terminal of the MOSFET to a gate terminal of the MOSFET). In this manner, the MOSFET, like a diode, allows current to flow from the drain terminal to the source terminal, but prevents current from flowing from the source terminal to the drain terminal. Accordingly, a MOSFET may be used to provide reverse current protection in a circuit.

SUMMARY

Certain examples disclosed herein correct gate bias for a diode-connected transistor. An example system includes a first resistor including a first resistor terminal and a second resistor terminal, a second resistor including a first resistor terminal and a second resistor terminal; a first transistor including a current terminal and a gate terminal, the current terminal of the first transistor coupled to the first resistor terminal of the first resistor and the gate terminal of the first transistor is coupled to the second resistor terminal of the first resistor; and a second transistor including a first current terminal and a second current terminal, the first current terminal of the second transistor coupled to the gate terminal of the first transistor, and the second current terminal of the second transistor coupled the first current terminal of the second resistor.

BRIEF DESCRIPTION OF THE DRAWINGS

The figures are not to scale. Wherever possible, the same reference numbers will be used throughout the drawing(s) and accompanying written description to refer to the same or like parts.

Figure 1:
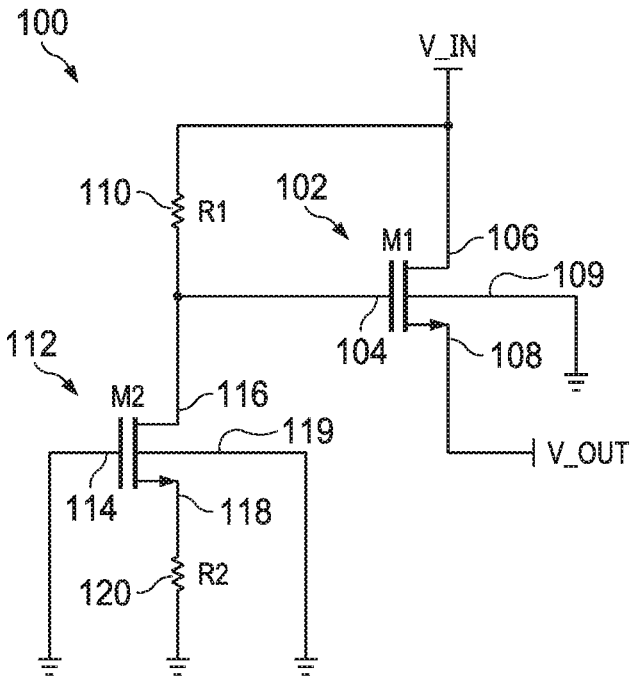
FIG. 1 illustrates an example circuit to correct gate bias for an example transistor.

Descriptors "first," "second," "third," etc. are used herein when identifying multiple elements or components which may be referred to separately. Unless otherwise specified or understood based on their context of use, such descriptors are not intended to impute any meaning of priority, physical order or arrangement in a list, or ordering in time but are merely used as labels for referring to multiple elements or components separately for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for ease of referencing multiple elements or components.

DETAILED DESCRIPTION

A diode-connected transistors is a transistor including terminals connected in a circuit so that the transistor acts as a two-terminal rectifying device, such as a diode. For example, an n-channel MOSFET can be configured to operate as a diode when the gate terminal is coupled to the drain terminal. A diode-connected transistor allows current to flow in a first direction (e.g., from a first current terminal (drain) of the transistor to a second current terminal (source) of the transistor) and prevents current (e.g., reverse current) from flowing in a second direction (e.g., from the second current terminal to the first current terminal) opposite of the first direction. In this manner (e.g., because the drain terminal is connected to the source terminal), if the voltage (Vd) at the drain terminal (e.g., which is the same as the voltage at the gate terminal) of an n-channel MOSFET is a threshold voltage (Vt, also referred to as a forward voltage drop) above the voltage (Vs) at the source terminal of the n-channel MOSFET, the MOSFET is enabled (e.g., because $Vgs>Vt$, where Vgs is $Vg-Vs$). When the MOSFET is enabled, current can flow from a first current terminal of the MOSFET to a second current terminal of the MOSFET. Accordingly, like a forward biased diode, when the voltage at a first current terminal of the MOSFET (e.g., corresponding to the anode terminal of a forward biased diode) is above a threshold voltage, current flows from the first current terminal to a second current terminal of the MOSFET (e.g., corresponding to the cathode terminal of a forward biased diode).

However, if the voltage at the first current terminal is below the threshold voltage above the voltage at the second current terminal, the MOSFET is disabled (e.g., because Vgs<Vt). When the MOSFET is disabled, current (e.g., reverse current) is prevented from flowing from the second terminal of the MOSFET to the first terminal of the MOSFET. Accordingly, like a reverse biased diode, when the voltage at a first current terminal (e.g., corresponding to the anode terminal of a diode) of the MOSFET is below the threshold voltage, reverse current from the second current terminal of the MOSFET (e.g., corresponding to the cathode terminal of a diode) to the first current terminal of the MOSFET is prevented from flowing. The threshold voltage of a MOSFET is based on the characteristics of the MOSFET (e.g., flatband voltage of the MOSFET, the bulk protentional of the MOSFET, and voltage across the oxide of the MOSFET due to the depletion layer charge).

One benefit of using a diode-connected transistor is that some diode-connected transistors (e.g., depending on the threshold voltage of the transistors) have a lower forward voltage drop than a conventional diode. A forward voltage drop is the maximum amount of voltage differential between the terminals of a diode (e.g., the maximum voltage differential between the current terminals of the diode-connected MOSFET) needed for the diode, or diode-connected MOSFET, to conduct current (e.g., allowing current to flow from the first terminal to the second terminal). An ideal diode has a forward voltage drop of 0V. However, in practice, simple diodes have a forward voltage drop of several hundred millivolts. Some devices can be fabricated to operate like a diode with a voltage drop of only a few millivolts, but such diode-based devices require hundreds of components. Thus, such diodes are large, expensive, and complicated. On the other hand, the forward voltage drop of a diode-connected transistor is the threshold voltage of the transistor, which is typically on the order of a several hundred millivolts to a few millivolts. Accordingly, a single diode-connected transistor with a small threshold voltage can act as a diode with a small forward voltage drop.

Diode-connected transistors have traditionally been structured to operate when the transistor is operating in enhanced mode, as opposed to depletion mode. In enhancement mode, the transistor is turned on (e.g., enabled) when the gate-to-source voltage (Vgs) is greater than the threshold voltage (Vt) of the transistor and turned off (e.g., disabled) when the Vgs is less than Vt. In depletion mode, the transistor is turned on (e.g., enabled) when the gate-to-source voltage (Vgs) is greater than the threshold voltage (Vt) of the transistor and turned off (e.g., disabled) when the Vgs is less than Vt. Accordingly, when a diode-connected transistor is operating in depletion mode, when the voltage at the source terminal is above the voltage at the drain terminal, the transistor is turned on allowing reverse current to flow from the source terminal to the drain terminal because the functional Vgs (e.g., 0 V) is greater than the depletion Vt. Thus, because reverse current is not blocked, diode-connected transistors are not traditionally implemented with depletion mode transistors.

One problem of implementing a diode-connected transistor with a small threshold voltage corresponds to the manufacturing variance of generating such small threshold voltage transistors. Variance in manufacturing leads to variance in the threshold voltages of transistors. Accordingly, if transistors are desired with a threshold voltage of 100 millivolts and the threshold voltage variance is 200 millivolts, the actual threshold voltage of the transistors may be anywhere from −100 millivolts to 300 millivolts. When the threshold voltage of a transistor is a negative voltage, the transistor cannot operate as an enhanced mode transistor. Rather, the transistor operates as a depletion mode transistor.

When an enhanced mode transistor operates as a switch; the switch is OFF (e.g., disabled) when the voltage at the gate of the enhanced mode transistor is low. When the switch is disabled, there is no current path between a first current terminal of the transistor and a second current terminal of the enhanced mode transistor, thereby blocking current from flowing from the first current terminal to the second current terminal. Conversely, when the voltage at the gate of the enhanced mode transistor is high, the switch is enabled and there is a current path between the first current terminal and the second current terminal, thereby allowing current from the first current terminal to the second current terminal.

When a depletion mode transistor operates as a switch, the switch is ON (e.g., enabled) when the voltage at the gate of the enhanced mode transistor is low. For example, when the voltage at the gate of the enhanced mode transistor is low, the switch is enabled and there is a current path between a first current terminal of the transistor to a second current terminal of the enhanced mode transistor, thereby allowing current to flow from the first current terminal to the second current terminal. Accordingly, a diode-connected transistor implemented with a depletion mode transistor will not operate as a diode, because the diode-connected transistor will be enabled when the reverse current flows from the second current terminal of the transistor to the first current terminal of the transistor, thereby allowing a reverse current to flow from the source terminal to the drain terminal instead of blocking the reverse current.

Additionally, temperature can affect the threshold voltage of a transistor. Thus, a low threshold voltage transistor may operate as an enhanced mode transistor initially, but as the temperature of the diode increases, the threshold voltage decreases. Accordingly, some low threshold voltage transistors may change from enhanced mode to depletion mode as a function of temperature.

Examples disclosed herein describe a correcting gate bias circuit coupled to a diode-connected transistor. The correction gate bias circuit ensures that the diode-connected transistor operates as a diode regardless of whether the transistor is an enhanced mode transistor or a depletion mode transistor. In this manner, a low threshold voltage transistor corresponding to low forward voltage drop may be used to operate as a diode without worrying about the effects of the threshold voltage tolerance and/or the effects of temperature on the threshold voltage. The example diode-based circuit (e.g., the correcting gate bias with a diode-connected transistor) disclosed herein may be used in any circuit and/or system where diodes can be implemented (e.g., to provide reverse current blockage between two components of the system). For example, the diode-based circuit may be used to provide reverse current blockage in a USB pin (e.g., a Type-C CC pin pull-up circuit), a gate driver in a power converter, etc.

Some field-effect transistors include of two gate terminals (e.g., a front terminal and a back terminal) and two current terminals (e.g., a source terminal and a drain terminal). In such examples, the gate terminals may be defined structurally while the current terminals may be defined functionally (electrically). For an n-channel device, positive channel current flows from drain terminal to the source terminal and the drain voltage is higher than the source voltage. For a p-channel device, positive channel current flows from the source terminal to the drain terminal and the source voltage is higher than the drain voltage. Therefore, in such examples, the source and drain terminals are a function of the transistor operating conditions and can switch as these conditions change.

Even though the field-effect transistor drain and source terminals may be functionally (electrically) defined, field-effect transistor symbols are typically drawn to identify source and drain terminals. In non-symmetric transistors, the symbol can communicate preferred source and drain terminals. Additionally, most circuits have operating conditions where the functional (electrical) source and/or drain terminals mostly match the drawn (symbolic) source/drain terminals. Accordingly, using symbols with identified source and/or drain terminals can assist with schematic understanding. However, a circuit operating conditions can mean that the functional (electrical) source/drain terminals will be opposite the drawn (symbolic) source/drain terminals.

With respect to the current sources of a transistor, a current terminal is herein used to refer to a source terminal and/or a drain terminal of the transistor. The source terminal and drain terminal of the transistor may be the symbolic (as referred to herein as "drawn") source terminal and the symbolic drain terminal of a transistor or a electrical (as referred to herein as "functional") drain terminal and the electrical source terminal of a transistor. For example, when the symbolic drain terminal of a transistor is coupled to an input node and the symbolic source terminal of the transistor is coupled to an output node and the voltage at the input node is less than the voltage at the output node, the symbolic drain terminal acts the electrical source terminal and the symbolic source terminal acts as the electrical drain terminal. Accordingly, as used herein, a current terminal of a transistor may correspond to (A) an symbolic drain terminal or electrical source terminal (e.g., depending on the voltage at the current terminals) or (B) an symbolic source terminal or a electrical drain terminal.

FIG. 1 illustrates an example circuit 100 (e.g., correction gate bias circuit) to correct gate bias for an example transistor M1 102. The example circuit 100 of FIG. 1 includes the example transistor M1 102. The transistor M1 102 includes an example gate terminal 104, a first example current terminal (e.g., a drain terminal) 106, a second example current terminal (e.g., a source terminal) 108, and an example substrate terminal (e.g., body terminal) 109. The example circuit 100 further includes example resistors (e.g., R1, R2) 110, 120 and an example transistor (e.g., transistor M2) 112. The example transistor M2 112 includes an example gate terminal 114, a first example current terminal (e.g., a drain terminal) 116, a second example current terminal (e.g., a source terminal) 118, and an example substrate terminal 119. In the illustrated example of FIG. 1, the example transistors M1, M2 102, 112 and the example resistors 110, 120 are implemented in the same die. However, the components may be implemented in different die and/or different packages based on user and/or manufacturer preferences. The example circuit 100 may be used to allow current in a first direction and block reverse current in a second direction opposite of the first direction in any system, such as in a USB pin (e.g., a Type-C CC pin pull-up circuit), in a gate driver in a power converter, etc. Although the example circuit 100 has nodes coupled to ground, the nodes may be coupled to other nodes of a circuit.

Although the example current terminal 106 is referred to as a drain terminal and the example current terminal 108 is referred to a source terminal, when the output voltage is greater than the input voltage, the example current terminal 108 acts as a drain terminal (e.g., an electrical drain terminal) and the example current terminal 106 acts as a source terminal (e.g., an electrical source terminal). Accordingly, when the output voltage is greater than the input voltage, the example current terminal 106 may be referred to as an electrical source terminal and the current terminal 108 may be referred to as an electrical drain terminal.

The example transistor M1 102 of FIG. 1 is an n-channel field effect transistor (e.g., an n-channel MOSFET, an NFET, a NMOS, etc.). The example gate terminal 104 of the example transistor M1 102 is coupled to the example resistor 110 (e.g., a second resistor terminal of the resistor 110) and the example first current terminal 116 of the example transistor M2 112. The first current terminal 106 of the example transistor M1 102 is coupled to an input node and the example resistor 110 (e.g., a first resistor terminal of the resistor 110). The input node corresponds to an input voltage (Vin), the voltage protentional at the input node. The second example current terminal 108 is coupled to an output node. The output node may be, for example, a processor or other component. The output node corresponds to an output voltage (Vout), the voltage potential at the output node. The example substrate terminal 109 of the example transistor M1 102 is coupled to ground (e.g., a node that is coupled to ground). The example transistor M1 402 is structured as a diode-connected transistor.

The example transistor M1 102 of FIG. 1 may operate in enhanced mode and/or depletion mode. In some examples, a manufacturer may generate the example transistor M1 102 to have a very low threshold voltage and operate in enhanced mode. However, due to the tolerance associated with the manufacturing of the example transistor M1 102, the actual threshold voltage may be negative, thereby operating in depletion mode. In some examples, the transistor M1 102 may operate in enhanced mode (e.g., where Vt>0 V). However, external factors (e.g., temperature) may change to cause the threshold voltage to decrease below 0 V and unintendedly operate in depletion mode (e.g., where Vt<0 V). In some examples, a manufacturer may prefer to implement the example transistor M1 102 with a depletion mode diode (e.g., as opposed to a low threshold voltage enhancement diode) to ensure that the lowest forward voltage drop is achieved.

The example transistor M2 112 of FIG. 1 is an n-channel MOSFET. The threshold voltage of the transistor M2 112 is the same (e.g., equal) and/or substantially similar (e.g., substantially equal) to the threshold voltage of the example transistor M1 102, wherein the amount of acceptable different between the threshold voltage depends on an acceptable amount of leakage current for the circuit 100, the difference in the resistances of the example resistors R1, R2, 110, 120, and/or any of adjustable characteristics of the example circuit 100). In some examples, the larger the difference between the threshold voltages of the transistors M1, M2 102, 112 (e.g., when the transistor M1 102 has a stronger depletion than the transistor M2 112), the more reverse leakage current will flow from the Vout node to the Vin node (e.g., where Vt>0 V). Accordingly, a user and/or manufacturer may select the transistor M2 112 to have a particular threshold voltage to the threshold voltage of transistor M1 102 based on an acceptable amount of leakage current. The example gate terminal 114 of the example transistor M2 112 is coupled to ground. The first current terminal 116 of the example transistor M2 112 is coupled to the example resistor 110 and the gate terminal 104 of the example transistor M1 102. The second example current terminal 118 is coupled to ground via the example resistor R2 120. For example, the second example current terminal 118 is coupled to a first resistor terminal of the example resistor R2 120 and a second resistor terminal of the example resistor R2 120 is coupled to the ground node. Because both the example gate terminal 114 and the second example current terminal 118 are coupled to ground, the example transistor 112 is always OFF (e.g., disabled) when the transistor M2 112 is operating in enhanced mode and is always ON (e.g., enabled) when the transistor M2 112 is operating in depletion mode. The example substrate terminal 119 of the example transistor M2 112 is coupled to ground.

The example transistor M2 112 of FIG. 1 may operate in enhanced mode and/or depletion mode. In some examples, a manufacturer may generate the example transistor M2 112 to have a very low threshold voltage and operate in enhanced mode. However, due to the tolerance associated with the manufacturing of the example transistor M2 112, the actual threshold voltage may be negative, thereby operating in depletion mode. In some examples, the transistor M2 112 may operate in enhanced mode. However, external factors (e.g., temperature) may change to cause the threshold voltage to decrease below 0 V and unintendedly operate in depletion mode.

The example resistors R1, R2 110, 120 of FIG. 1 have the same (e.g., equal), or substantially similar (e.g., substantially equal) (e.g., based on the tolerance of the resistors), resistances. For example, the resistors R1, R2 110, 120 may be manufactured in the same manner in the same die to have the same and/or substantially similar resistances. In some examples, the resistors R1, R2 110, 120 have similar resistances. For example, if some reverse leakage current is acceptable in a circuit and/or system, the resistances of the two resistors R1, R2 110, 120 can be different and still be within the acceptable range of leakage current. Additionally or alternatively, the resistances of the example resistors R1, R2 110, 120 may be selected to account for differences between the threshold voltages of the example transistors M1, M2 102, 112. In some examples, the resistors R1 110 may have a larger resistance than R2 to compensate for other mismatches in the circuit (e.g., voltage threshold mismatches between transistors M1, M2, 102, 112) to increase the amount of negative compensation that can be applied to the high side transistor.

In the illustrated example of FIG. 1, the threshold voltage of the example transistor M1 102 is the same as, or substantially similar to (based on the tolerance of the transistors), the threshold voltage of the example transistor M2 112. For example, the transistors M1, M2 102, 112 may be manufactured in the same manner in the same die to have the same and/or substantially similar characteristics. In some examples, the transistors M1, M2 102, 112 have similar threshold voltages. For example, if some reverse leakage current is acceptable in a circuit and/or system, the threshold voltages of the two transistors M1, M2 102, 112 can be different and still be within the acceptable range of leakage current. Because the threshold voltages are the same, or substantially similar, the example the example transistors M1, M2 102, 112 will operate in depletion mode at the same time and will operate in enhanced mode at the same time. In depletion mode, the example transistors M1, M2, 102, 112 create a current mirror, where the current through the example transistor M2 112 (e.g., the current from the example first current terminal 116 to the example second current terminal 118) sets the maximum reverse current through the example transistor M1 102 to create a Vgs adjustment voltage (e.g., by biasing the Vg) for the example transistor M1 102. As further described below in conjunction with FIGS. 2 and 3, the example circuit 100 allows the example transistors 102 to operate as a diode regardless of whether the transistor 102 operates in depletion mode (e.g., the threshold voltage is below 0V) or in enhanced mode (e.g., the threshold voltage is above 0V). Advantageously, a manufacturer can select the transistor 102 to have a very low, or negative, threshold voltage to reduce the forward voltage drop, while ensuring diode operation without a large, complex, and expensive circuit. Even if an external factor (e.g., temperature) causes the example transistor 102 to adjust from enhanced mode to depletion mode, the example circuit 100 will ensure diode operation in the depletion mode, as further described below in conjunction with FIG. 3.

Figure 2:
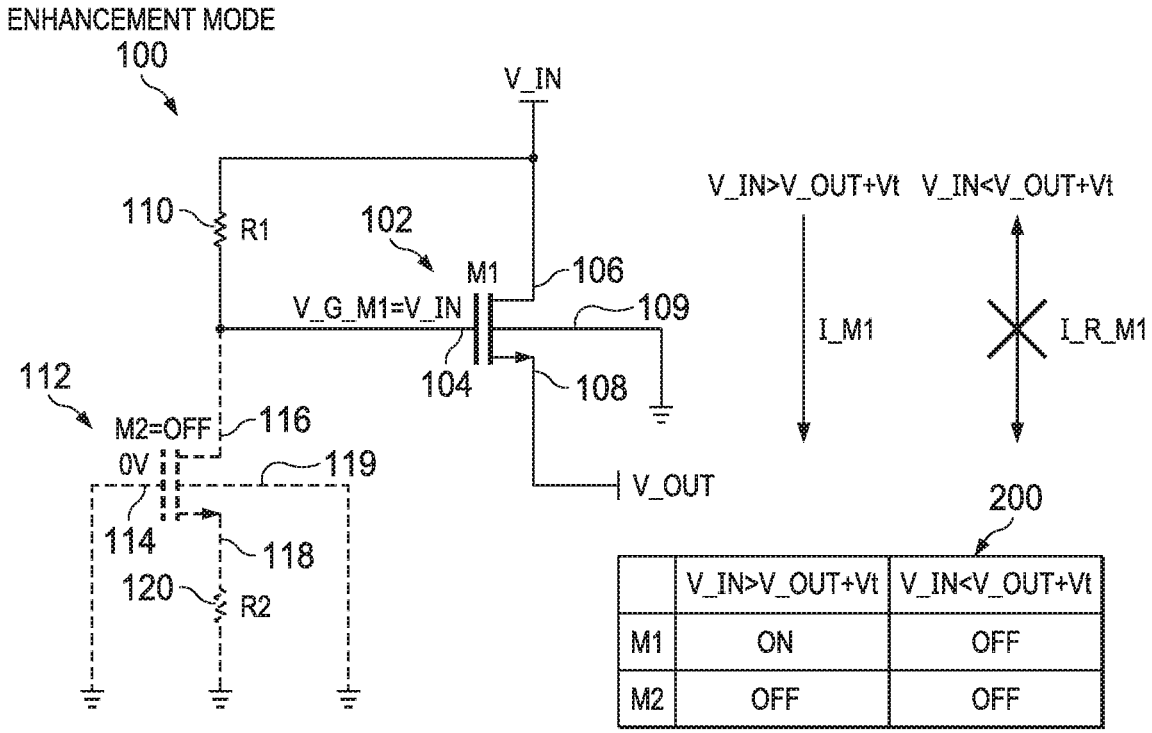
FIG. 2 illustrates operation of the example circuit of FIG. 1 when the transistor is operating in enhanced mode.

FIG. 2 illustrates the example circuit 100 of FIG. 1 to correct gate bias for the example transistor M1 102 while the example transistor M1 102 and the example transistor 112 are operating in enhanced mode. The example circuit 100 of FIG. 2 the example gate terminal 104, the first example current terminal (e.g., a drain terminal) 106, the second example current terminal (e.g., a source terminal) 108, and the example substrate terminal (e.g., body terminal) 109 of the example transistor M1 102 of FIG. 1. The example circuit 100 of FIG. 2 further includes the example resistors (e.g., R1, R2) 110, 120 of FIG. 1. The example circuit 100 of FIG. 2 further includes the example gate terminal 114, the first example current terminal (e.g., a drain terminal) 116, the second example current terminal (e.g., a source terminal) 118, and the example substrate terminal 109 of the example transistor M1 112 of FIG. 1. FIG. 2 further includes an example table 200 identifying the states of the example transistors M1, M2, 102, 112 based on the input voltage (V_IN) and the output voltage (V_OUT).

Because the example transistors M1, M2 102, 112 of FIG. 2 have the same or a substantially similar threshold voltage, when the example transistor M1 102 operates in enhancement mode (e.g., the threshold voltage of transistor M1 102 is greater than 0V), the example transistor M2 112 also operates in enhancement mode (e.g., the threshold voltage of the transistor M2 112 is greater than 0V). Accordingly, because the gate terminal 114 and the second example current terminal 118 of the example transistor M2 112 is grounded, the example transistor M2 112 will be disabled (e.g., off) during enhanced mode operation, as shown in the example table 200. Thus, there will be no current flowing from the node between the example resistor 110 and the gate terminal 104 of the example transistor M1 102 (e.g., as represented by the dashed lines of FIG. 2).

Because the gate terminal 104 of the example transistor M1 102 is coupled to the input voltage (V_IN) via the example resistor 110, the voltage at the gate terminal 104 (e.g., V_G_M1) is equal to the input voltage (V_IN). Additionally, the voltage at the first current terminal 106 is equal to the input voltage and the voltage at the second current terminal 108 is equal to the output voltage. Accordingly, when the input voltage is above a sum of a threshold voltage (e.g., the threshold voltage of the example transistor M1 102) and the output voltage, the gate-to-source voltage (Vgs) of the example transistor M1 102 (e.g., the voltage differential between the voltage at the gate terminal 104 and the voltage at the second current terminal 108) will be higher than the threshold voltage of the transistor M1 102. Thus, as shown in the example table 200, the example transistor M1 102 will be enabled (e.g., turned on) and current (e.g., I_M1) can flow in a first direction from the first current terminal 106 to the second current terminal 108. However, when the input voltage is below a sum of the threshold voltage and the output voltage, the gate-to-source voltage (Vgs) of the example transistor M1 102 will be lower than the threshold voltage of the transistor M1 102. Thus, as shown in the example table 200, the example transistor M1 102 will be disabled (e.g., turned off) and reverse current (e.g., I_R_M1) in a second direction opposite the first direction will be blocked. Additionally, when the example transistor M1 102 is disabled current in the first direction will likewise be blocked. Accordingly, in enhanced mode when Vin<Vout, the example circuit 100 acts as a diode.

Figure 3:
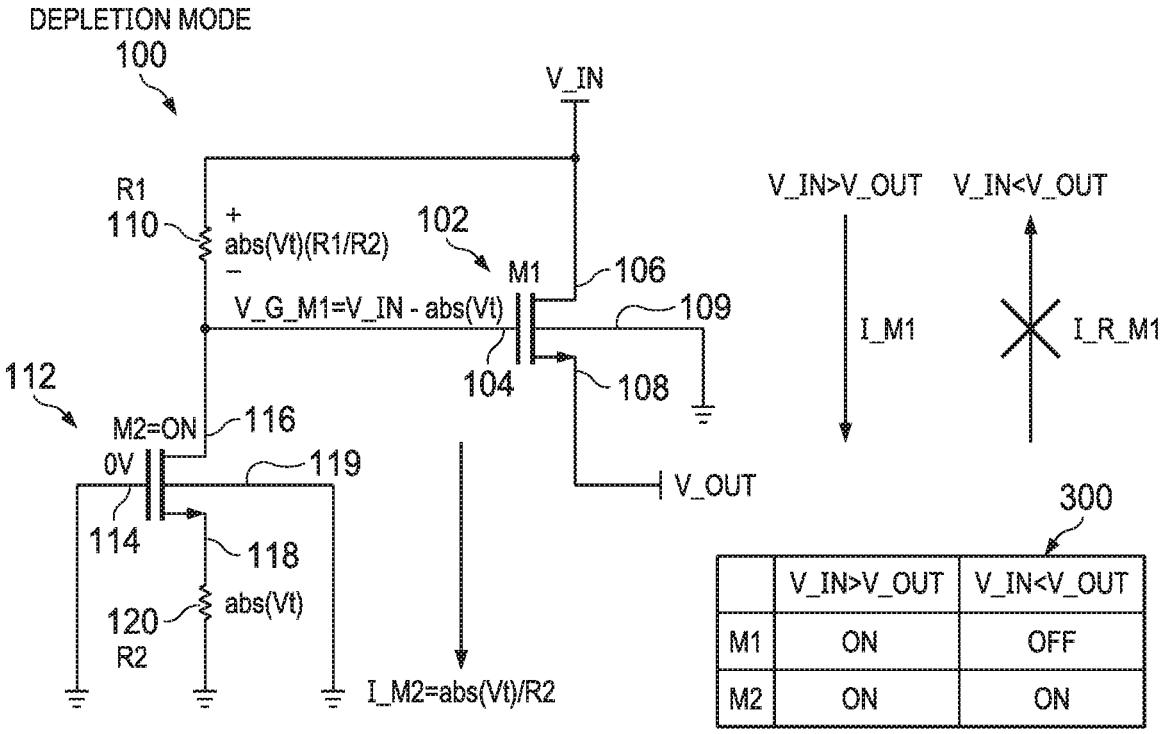
FIG. 3 illustrates operation of the example circuit of FIG. 1 when the transistor is operating in depletion mode.

FIG. 3 illustrates the example circuit 100 of FIG. 1 to correct gate bias for the example transistor M1 102 while the example transistor M1 102 and the example transistor 112 are operating in depletion mode. The example circuit 100 of FIG. 3 the example gate terminal 104, the first example current terminal (e.g., a drain terminal) 106, the second example current terminal (e.g., a source terminal) 108, and the example substrate terminal (e.g., body terminal) 109 of the example transistor M1 102 of FIG. 1. The example circuit 100 of FIG. 3 further includes the example resistors (e.g., R1, R2) 110, 120 of FIG. 1. The example circuit 100 of FIG. 3 further includes the example gate terminal 114, the first example current terminal (e.g., a drain terminal) 116, the second example current terminal (e.g., a source terminal) 118, and the example substrate terminal 109 of the example transistor M1 112 of FIG. 1. FIG. 3 further includes an example table 300 identifying the states of the example transistors M1, M2, 102, 112 based on the input voltage (V_IN) and the output voltage (V_OUT).

Because the example transistors M1, M2 102, 112 of FIG. 2 have the same or a substantially similar threshold voltage, when the example transistor M1 102 operates in depletion mode (e.g., the threshold voltage of transistor M1 102 is less than 0V), the example transistor M2 112 also operates in depletion mode (e.g., the threshold voltage of the transistor M2 112 is less than 0V). Accordingly, because the gate terminal 114 of the example transistor M2 112 is grounded and the voltage at the second example current terminal 118 of the example is not negative, the example transistor M2 112 will be enabled (e.g., on) during depletion mode operation, as shown in the example table 200. Accordingly, there will be current (e.g., I_M2) flowing from the first current terminal 116 to the second current terminal 118 of the example transistor M2 112 (e.g., from the node between the example resistor 110 and the gate terminal 104 of the example transistor M1 102 to ground via the example resistor R2 120).

Because the example transistor M2 112 of FIG. 2 is in depletion mode (e.g., Vt<0V) and the drain current in saturation of the transistor M2 112 corresponds to Vgs−Vt (e.g., Id $\alpha$ (Vgs−Vt)2), even if Vgs is 0V, the drain current of the example transistor M2 112 is positive, thereby forming a channel in the example transistor M2 112. As the current flows from the first current terminal 116 through the newly formed channel to the second current terminal 118, the voltage (e.g., source voltage) at the second current terminal 118 will rise up from 0V to the Vgst (e.g., Vgs−Vt) of what the transistor M2 112 can support. When the resistance of the example resistor R2 120 is sufficiently large, the Vgst is almost zero. In this manner, the voltage at the second current terminal 118 is approximately equal to the absolute value (abs) of $V_t$. Because the voltage at the second current terminal 118 is $V_t$, the current (e.g., I_M2) from the first current terminal 116 to the second current terminal 118 of the example transistor M2 112 is equal to the absolute value of $V_t$ divided by the resistance of R2 120 (e.g., abs(Vt)/R2), based on Ohm's Law.

The current across the example resistor R1 is the same current (e.g., I_M2) that flows through the example transistor M2 112 (e.g., from the first current terminal 116 to the second current terminal 118 to ground via the resistor R2 120). Accordingly, based on Ohm's law, the voltage drop across the example resistor R1 110 is equal to product of I_M2 and the resistance of the resistor R1 110 (e.g., (I_M2)(R1)). Because I_M2 is equal to abs(Vt)/R2, the voltage drop across the example resistor R1 110 is equal to the product of (i) the absolute value of Vt and (ii) a quotient of R1 and R2 (e.g., abs(Vt)(R1/R2)). Thus, the voltage at the gate terminal 104 (e.g., I_G_M1) of the example transistor M1 102 is equal to the input voltage minus the voltage across the example resistor R1 110 (e.g., V_G_M1=V_IN−abs(Vt)(R1/R2)). As described above, in some examples, the resistance of the example resistors R1, R2 110, 120 are equal or substantially equal. Accordingly, in such examples, the voltage at the gate terminal 104 of the example transistor M1 102 is equal to the input voltage minus the absolute value of the threshold voltage (e.g., V_IN−abs(Vt)). Thus, the example transistor M2 112 is structured to bias the voltage at the gate terminal of the example transistor M1 102 when in depletion mode by drawing current across the second resistor R2 120. For example, the biased voltage at the gate terminal 104 is the input voltage biased by the threshold voltage (e.g., V_IN−abs(Vt)).

As shown in the example table 300, during depletion mode of the example transistor M1 102, the transistor M1 102 is enabled (e.g., on) when the input voltage is larger than the output voltage. To enable the example transistor M1 102 during depletion mode, the Vgs needs to be greater than the threshold voltage. When the input voltage (V_IN) is greater than the output voltage (V_OUT), the source terminal of the example transistor M1 102 is the second current terminal 108. Thus, because Vg of the example transistor M1 102 is equal to V_IN−abs(Vt) and Vs of the example transistor M1 102 is V_OUT, Vgs is equal to V_IN−abs(Vt)−V_OUT. When the input voltage (V_IN) is greater than the output voltage (V_OUT), V_IN−abs(Vt)−V_OUT will always be greater than Vt. Thus, when V_IN is greater than V_OUT, the example transistor M1 102 will be enabled in depletion mode, thereby causing the I_M1 current to flow from the first current terminal 106 to the second current terminal 108.

As shown in the example table 300, during depletion mode of the example transistor M1 102, the transistor M1 102 is disabled (e.g., off) when the input voltage is smaller than the output voltage. To disable the example transistor M1 102 during depletion mode, the Vgs−Vt needs to be less than zero. When the input voltage (V_IN) is less than the output voltage (V_OUT), the first current terminal 106 acts as the source terminal of the example transistor M1 102 (e.g., the first current terminal 106 is an electrical source terminal). Thus, because Vg of the example transistor M1 102 is equal to V_IN−abs(Vt) and Vs of the example transistor M1 102 is V_IN, Vgs is equal to V_IN−abs(Vt)−V_IN. Thus, the reverse Vgs (e.g., when the first current terminal 106 acts as a source terminal) is equal to −abs(Vt). Accordingly, Vgs−Vt becomes−abs(Vt)−Vt, which equals 0 V. Thus, when V_IN is less than V_OUT, the example transistor M1 102 will be disabled in depletion mode (e.g., because Vgs−Vt≤0V when Vgs−Vt=0V), thereby blocking the reverse current (I_R_M1) from to flow from the second current terminal 108 to the first current terminal 106. Accordingly, the example circuit 100 acts as a diode when the example transistor M1 102 is in depletion mode.

Figure 4A:
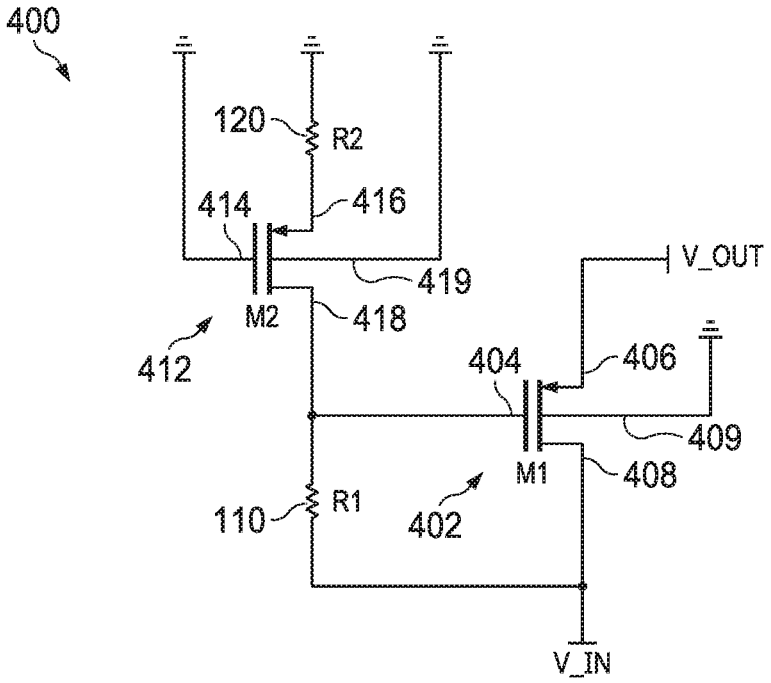
FIGS. 4A-4C illustrate alternative example circuits to correct gate bias for an example transistor.

FIG. 4A illustrates an alternative example circuit 400 to correct gate bias for an example transistor M1 402. The example circuit 400 of FIG. 4A includes the example resistors R1, R2 110, 120 of FIG. 1 The example circuit 400 further includes the example transistor M1 402. The transistor M1 402 includes an example gate terminal 404, a first example current terminal (e.g., a source terminal) 406, a second example current terminal (e.g., a drain terminal) 408, and an example substrate terminal (e.g., body terminal) 409. The example circuit 400 further includes an example transistor (e.g., transistor M2) 412. The example transistor M2 412 includes an example gate terminal 414, a first example current terminal (e.g., a source terminal) 416, a second example current terminal (e.g., a drain terminal) 418, and an example substrate terminal 419. In the illustrated example of FIG. 1, the example transistors M1, M2 402, 412 and the example resistors 110, 120 are implemented in the same die. However, the components may be implemented in different die and/or different packages based on user and/or manufacturer preferences. Although the example circuit 400 has nodes coupled to ground, the nodes may be coupled to other nodes of a circuit.

The example transistor M1 402 of FIG. 4A is a p-channel field effect transistor (e.g., a p-channel MOSFET, a PFET, a PMOS, etc.). The example gate terminal 404 of the example transistor M1 402 is coupled to the example resistor 110 and the example second current terminal 418 of the example transistor M2 412. The first example current terminal 406 is coupled to an output node. The output node may be, for example, a processor or other component. The output node corresponds to an output voltage (Vout), the voltage potential at the output node. The second current terminal 408 of the example transistor M1 402 is coupled to an input node and the example resistor 110. The input node corresponds to an input voltage (Vin), the voltage protentional at the input node. The example substrate terminal 409 of the example transistor M1 402 is coupled to ground. The example transistor M1 402 is structured as a diode-connected transistor.

The example transistor M1 402 of FIG. 4A may operate in enhanced mode and/or depletion mode. In some examples, a manufacturer may generate the example transistor M1 402 to have a very low absolute threshold voltage (e.g., the absolute value of the threshold voltage is very low) and operate in enhanced mode. However, due to the tolerance associated with the manufacturing of the example transistor M1 402, the actual threshold voltage may be positive, thereby operating in depletion mode. In some examples, the transistor M1 402 may operate in enhanced mode (e.g., where Vt<0 V). However, external factors (e.g., temperature) may change to cause the threshold voltage to decrease above 0 V and unintendedly operate in depletion mode (e.g., where Vt>0 V).

The example transistor M2 412 of FIG. 4A is a p-channel MOSFET. The threshold voltage of the transistor M2 412 is the same and/or substantially similar to the threshold voltage of the example transistor M1 402. The larger the difference between the threshold voltages of the transistors 402, 412 (e.g., when the transistor M1 402 has a stronger depletion than the transistor M2 412), the more reverse leakage current will flow from the Vout node to the Vin node. Accordingly, a user and/or manufacturer may select the transistor M2 412 to have a particular threshold voltage corresponding to the threshold voltage of transistor M1 402 based on an acceptable amount of leakage current. The example gate terminal 414 of the example transistor M2 412 is coupled to ground. The first example current terminal 416 is coupled to ground via the example resistor R2 120. The second current terminal 418 of the example transistor M2 412 is coupled to the example resistor 110 and the gate terminal 404 of the example transistor M1 402. Because both the example gate terminal 414 and the first example current terminal 416 are coupled to ground, the example transistor 412 is always OFF (e.g., disabled) when the transistor M2 412 is operating in enhanced mode and is always ON (e.g., enabled) when the transistor M2 412 is operating in depletion mode. The example substrate terminal 419 of the example transistor M2 412 is coupled to ground.

The example transistor M2 412 of FIG. 4A may operate in enhanced mode and/or depletion mode. In some examples, a manufacturer may generate the example transistor M2 412 to have a very low absolute threshold voltage and operate in enhanced mode. However, due to the tolerance associated with the manufacturing of the example transistor M2 412, the actual threshold voltage may be negative, thereby operating in depletion mode. In some examples, the transistor M2 412 may operate in enhanced mode. However, external factors (e.g., temperature) may change to cause the threshold voltage to decrease below 0 V and unintendedly operate in depletion mode.

In the illustrated example of FIG. 4A, the threshold voltage of the example transistor M1 402 is the same as, or substantially similar to (based on the tolerance of the transistors), the threshold voltage of the example transistor M2 412. For example, the transistors M1, M2 402, 412 may be manufactured in the same manner in the same die to have the same and/or substantially similar characteristics. In some examples, the transistors M1, M2 402, 412 have similar threshold voltages. For example, if some reverse leakage current is acceptable in a circuit and/or system, the threshold voltages of the two transistors M1, M2 402, 412 can be different and still be within the acceptable range of leakage current. Because the threshold voltages are the same, or substantially similar, the example the example transistors M1, M2 402, 412 will operate in depletion mode at the same time and will operate in enhanced mode at the same time.

In enhanced mode, the example transistor M2 412 is off (e.g., disabled). Accordingly, the voltage at the gate terminal 404 of the example transistor M1 402 is equal to the voltage at the input node. If the voltage at the input node (e.g., the voltage at the second current terminal 408) is less than the voltage at the output node (e.g., the voltage at the first current terminal 406) minus the absolute threshold voltage, the transistor M1 402 is enabled (e.g., turned on) and current flows from the first current terminal 406 to the second current terminal 408. However, if the voltage at the input node (e.g., the voltage at the second current terminal 408) is greater than the voltage at the output node (e.g., the voltage at the first current terminal 406) minus the absolute threshold voltage, the transistor M1 402 is disabled (e.g., turned off) and reverse current from the second current terminal 408 to the first current terminal 406 is blocked.

In depletion mode, the example transistors M1, M2, 402, 412 create a current mirror, where the current through the example transistor M2 412 (e.g., the current from the example second current terminal 418 to the example second current terminal 416) sets the maximum reverse current through the example transistor M1 402 to create a Vgs adjustment voltage (e.g., by biasing the Vg) for the example transistor M1 402. Thus, when the voltage at the input node is lower than the voltage at the output node and the transistor M1 402 is in depletion mode, the example transistor M1 402 is enabled (e.g., on) to allow current to flow from the first current terminal 406 to the second current terminal 408. Additionally, when the voltage at the input node is higher than the voltage at the output node plus the threshold voltage, the example transistor M1 402 is disabled (e.g., off) to block reverse current from flowing from the second current terminal 408 to the first current terminal 406.

Accordingly, the example circuit 400 allows the example transistor M1 402 to operate as a diode regardless of whether the transistor M1 402 operates in depletion mode (e.g., the threshold voltage is below 0V) or in enhanced mode (e.g., the threshold voltage is above 0V). Advantageously, a manufacturer can select the transistor M1 402 to have a very low, or negative, threshold voltage to reduce the forward voltage drop, while ensuring diode operation without a large, complex, and expensive circuit. Even if an external factor (e.g., temperature) causes the example transistor M1 402 to adjust from enhanced mode to depletion mode, the example circuit 400 will ensure diode operation in the depletion mode.

Figure 4B:
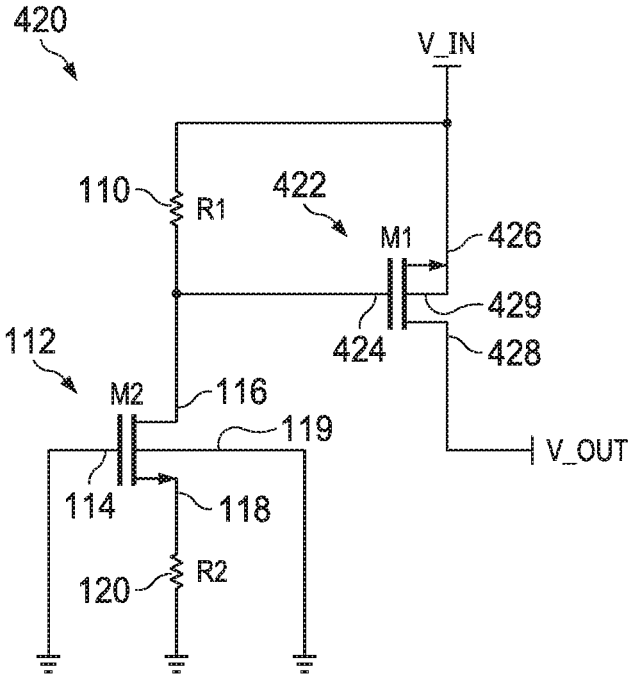

FIG. 4B illustrates an alternative example circuit 420 to correct gate bias for an example transistor M1 422. The example circuit 420 of FIG. 4B includes the example resistors R1, R2 110, 120, the example transistor M2 112, the example gate terminal 114, the example current terminals 116, 118, and the example substrate terminal 119 of FIG. 1. The example circuit 420 further includes the example transistor M1 422. The transistor M1 422 includes an example gate terminal 424, a first example current terminal (e.g., a source terminal) 426, a second example current terminal (e.g., a drain terminal) 428, and an example substrate terminal (e.g., body terminal) 429. In the illustrated example of FIG. 4B, the example transistors M1, M2 402, 112 and the example resistors 110, 120 are implemented in the same die. However, the components may be implemented in different die and/or different packages based on user and/or manufacturer preferences. Although the example circuit 420 has nodes coupled to ground, the nodes may be coupled to other nodes of a circuit.

The example transistor M1 422 of FIG. 4B is configured in a different manner than the example transistor M1 102 of FIG. 1, but operates in the same manner. For example, the transistor M1 422 is a NMOS flipped vertically. Accordingly, the example current terminal 426 is the source terminal and the example current terminal 428 is the drain terminal. The example substrate terminal 429 is coupled to the example current terminal 426. In this manner, the example transistor 422, when operating in enhancement mode, is on (e.g., enabled) when the example input voltage is a threshold voltage above the output voltage (e.g., to allow current to flow from the current terminal 426 to the current terminal 428) and the off (e.g., disabled) when the input voltage is below the output voltage (e.g., to block current from flowing from the example current terminal 428 to the example current terminal 426). Additionally, the example transistor 422 operates as a diode when the example transistor 422 operates in depletion mode, as described above in conjunction with FIGS. 1-3.

Figure 4C:
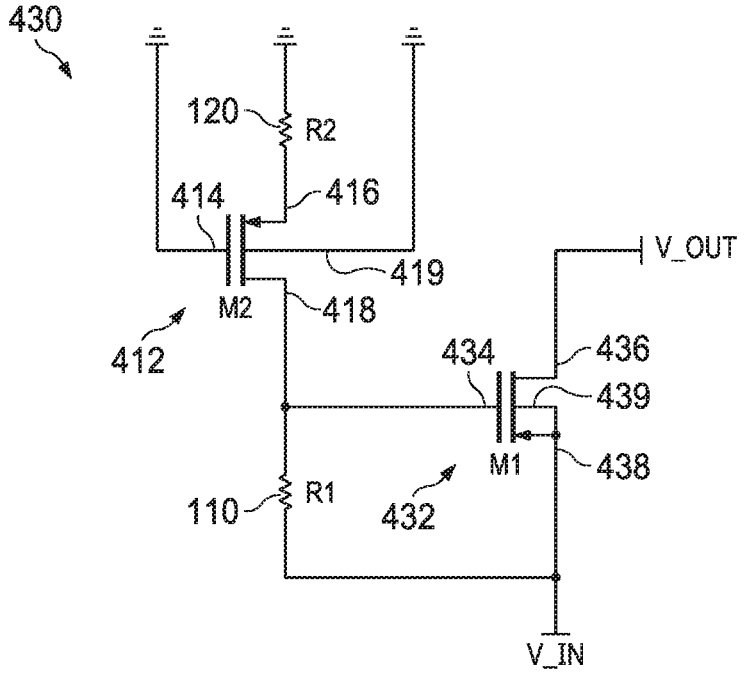

FIG. 4C illustrates an alternative example circuit 430 to correct gate bias for an example transistor M1 432. The example circuit 430 of FIG. 4C includes the example resistors R1, R2 110, 120, the example transistor M2 412, the example gate terminal 414, the example current terminals 416, 418, and the example substrate terminal 419 of FIG. 4A. The example circuit 430 further includes the example transistor M1 432. The transistor M1 432 includes an example gate terminal 434, a first example current terminal (e.g., a source terminal) 436, a second example current terminal (e.g., a drain terminal) 438, and an example substrate terminal (e.g., body terminal) 439. In the illustrated example of FIG. 4C, the example transistors M1, M2 402, 412 and the example resistors 110, 120 are implemented in the same die. However, the components may be implemented in different die and/or different packages based on user and/or manufacturer preferences. Although the example circuit 430 has nodes coupled to ground, the nodes may be coupled to other nodes of a circuit.

The example transistor M1 432 of FIG. 4B is configured in a different manner than the example transistor M1 402 of FIG. 4A, but operates in the same manner. For example, the transistor M1 432 is a PMOS flipped vertically. Accordingly, the example current terminal 436 is the drain terminal and the example current terminal 438 is the source terminal. The example substrate terminal 439 is coupled to the example current terminal 438. In this manner, the example transistor 432, when operating in enhancement mode, is on (e.g., enabled) when the example input voltage is a threshold voltage above the output voltage (e.g., to allow current to flow from the current terminal 438 to the current terminal 436) and the off (e.g., disabled) when the input voltage is below the output voltage (e.g., to block current from flowing from the example current terminal 436 to the example current terminal 438). Additionally, the example transistor 432 operates as a diode when the example transistor 432 operates in depletion mode, as described above in conjunction with FIG. 4A.

Figure 5:
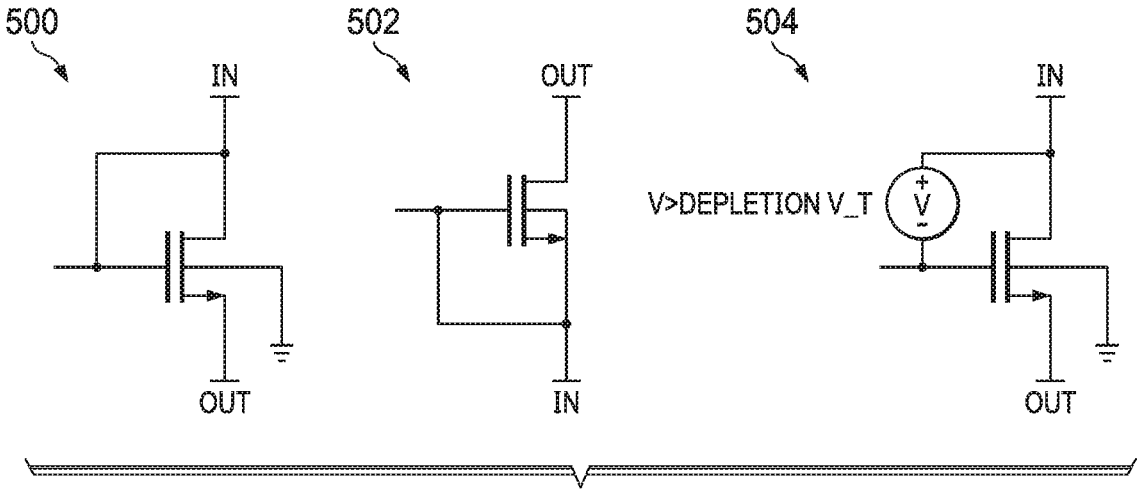
FIG. 5 illustrates example diode-connected transistors.

FIG. 5 illustrates alternative circuits for implementing a diode-connected transistor. FIG. 5 includes a first example diode-connected transistor 500, a second example diode-connected transistor 502, and a third example diode-connected transistor 504.

The first example diode-connected transistor 500 of FIG. 5 is a NMOS transistor with a gate terminal and a first current terminal (e.g., the drain terminal) coupled to the input voltage node and a second current terminal (e.g., a source terminal) coupled to the output voltage node. The example diode-connected transistor 500 operates as a diode in enhanced mode. However, in depletion mode, the diode-connected transistor 500 does not prevent reverse current (e.g., current from the second current terminal to the first current terminal) when the voltage at the output is more than the voltage at the input.

The example diode-connected transistor 502 of FIG. 5 is an alternative configuration of a diode-connected transistor. The example diode-connected transistor 502 is a NMOS transistor with a gate terminal and a second current terminal (e.g., a source terminal) coupled to the input voltage node and a first current terminal (e.g., a drain terminal) coupled to the output voltage node. Like the example diode-connected transistor 502, the example diode-connected transistor 502 acts as a reverse current blocking diode when the example diode-connected transistor 502 operates in enhanced mode. However, like the example diode-connected transistor 502, the example diode-connected transistor 502 does not block reverse current when the example diode-connected transistor 502 operates in depletion mode.

The example diode-connected transistor 504 of FIG. 5 includes a voltage source coupled between the gate terminal and the first current terminal (e.g., the drain terminal)/the input voltage terminal. The voltage source biases Vgs with a fixed voltage to always be set at the worst case depletion voltage. However, a voltage supply is a large and expensive component. Further, the example diode-connected transistor 504 may require more current to operate than the example circuits 100, 400 of FIGS. 1 and/or 4. Accordingly, the example diode-connected transistor 504 will need additional leakage components to reduce the leakage current which adds to the cost, complexity, and size of the example diode-connected transistor 504. Additionally, using the example diode-connected transistor 504, the worst case forward drop will range from 0.1 V to 0.6 V, when the range of the threshold voltage is between −0.3 V to 0.2 V and the voltage source is a 0.35 V to 0.4 V (e.g., taking into account tolerance). However, using the example circuits 100, 400, the worst case forward drop ranges from 0 V to 0.2 V, corresponding to a 0.4 V forward drop improvement.

Figure 6A:
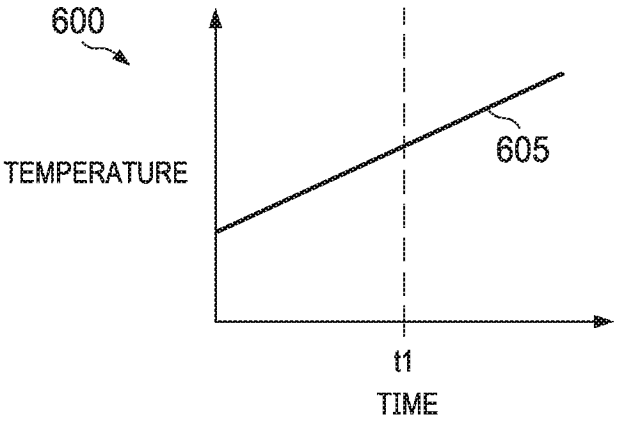
FIG. 6A is a timing diagram representative of temperature of the example circuits of FIGS. 1 and/or 4 to the example diode-connected transistors of FIG. 5 with respect to time.
Figure 6B:
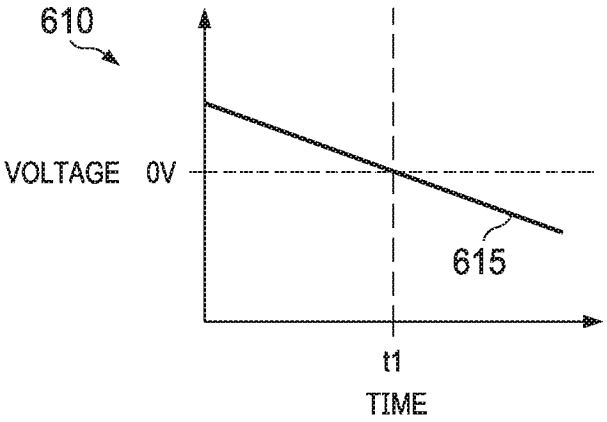
FIG. 6B is a timing diagram representative of threshold voltage of the example circuits of FIGS. 1 and/or 4 to the example diode-connected transistors of FIG. 5 with respect to time.
Figure 6C:
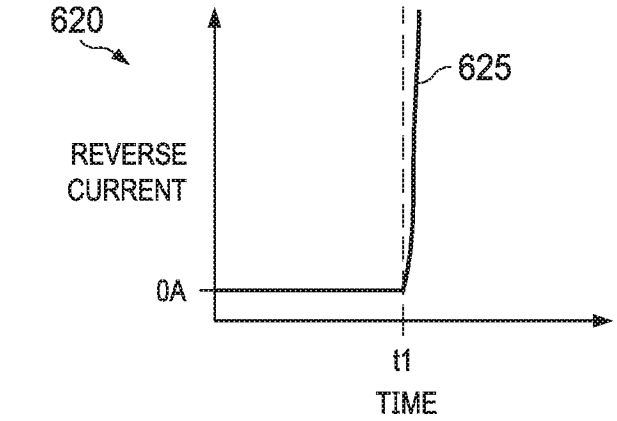
FIG. 6C is a timing diagram representative of the amount of reverse current in the example diode-connected transistors of FIG. 5 with respect to time in conjunction with the increased temperature and the decreased voltage threshold of FIGS. 6A-6B.
Figure 6D:
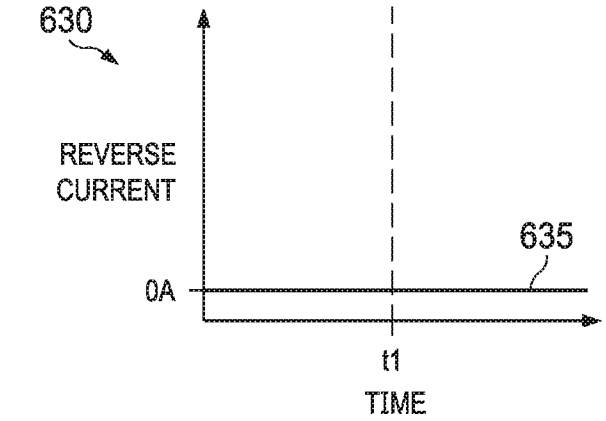
FIG. 6D is a timing diagram representative of the amount of reverse current in the example circuits of FIGS. 1 and/or 4 with respect to time in conjunction with the increased temperature and the decreased voltage threshold of FIGS. 6A-6B.

FIG. 6A-6D illustrate example timing diagrams, 600, 610, 620, 630 that illustrate a comparison of the operation of the example circuits 100, 400 of FIGS. 1 and 4 and the operation of the example transistors 500, 502 of FIG. 5 when the circuits change from enhanced mode to depletion mode. The example timing diagram 600 of FIG. 6A illustrates an example temperature 605 of the example circuits 100, 400 and/or transistors, 500, 502 with respect to time. The example timing diagram 610 of FIG. 6B illustrates an example threshold voltage 615 of the transistors 102, 402, 500, 502 with respect to time. The example timing diagram 620 of FIG. 6C illustrates an example reverse current 625 (e.g., the current from the source terminal to the drain terminal) of the transistors 500, 502 of FIG. 5 with respect to time. The example timing diagram 630 of FIG. 6D illustrates an example reverse current 635 (e.g., the current from the source terminal to the drain terminal) of the transistors 102, 402 of FIGS. 1 and/or 4 with respect to time. In the illustrated examples of FIGS. 6A-D, the example transistors 102, 402, 500, 502 correspond to the same threshold voltage (Vt) and the output voltage is larger than the input voltage.

In the example diagrams of FIG. 6A-6D, before time t1, the example transistors 102, 402, 500, 502 have a positive threshold voltage. Accordingly, because the output voltage is greater than the input voltage, the transistors 102, 402, 500, 502 are disabled, as further described above. Accordingly, the example reverse current 625, 635 is blocked before time t1 (e.g., the reverse current is equal to 0 Amperes (A)). As the example temperature 605 increased, the example threshold voltage 615 begins to decrease.

At time t1, the threshold voltage 615 becomes a negative voltage due to the increased temperature 605. Accordingly, the example transistors 102, 402, 500, 502 transition from enhanced mode to depletion mode. As such, at time t1, the example diode-connected transistors 500, 502 are enabled and the reverse current stops being blocked, allowing the example reverse current 625 to flow (e.g., from the source to the drain of the example diode-connected transistors 500, 502), as described above in conjunction with FIG. 5. Thus, the example reverse current 625 increases at time t1. However, as described above in conjunction with FIGS. 1-4, when the example transistors 102, 402 transition into depletion mode, the example transistors 102, 402 continue to block the example reverse current 635. Accordingly, the example reverse current 635 remains at 0 V after time t1.

Figure 7:
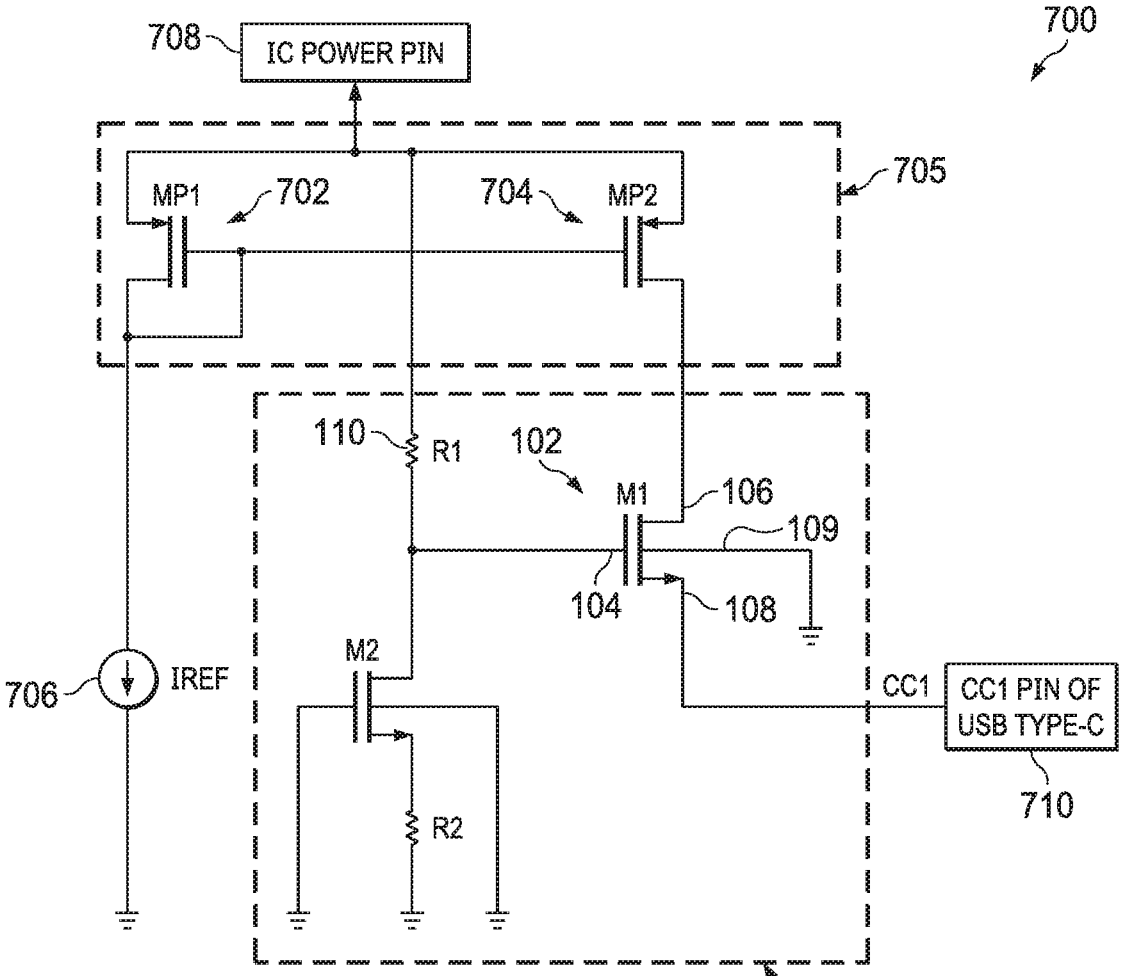
FIG. 7 is an example USB type C integrated circuit (IC) system implementing the example circuit of FIG. 1.

FIG. 7 is an example system diagram of the example circuit 100 implemented in an example USB type C integrated circuit (IC) system 700. The example USB type C IC system 700 includes the example circuit 100 of FIGS. 1-3, including the example transistor M1 102, the example gate terminal 104, the first example current terminal 106, the second example current terminal 108, and the example substrate terminal 109. The example USB type C IC system 700 further includes example transistors (MP1, MP2) 702, 704 structured in an example current mirror 705, an example reference current source 706, an example IC power pin 708 and an example CC1 pin 710 of a UCB type-C device. Although the example circuit 100 is used in the example USB type C integrated circuit (IC) system 700 of FIG. 7 to block reverse current, any one of the example circuits 400, 420, 430 of FIGS. 4A-4C could alternatively be used to block reverse current.

In the example USB type C IC system 700 of FIG. 7, the example transistors MP1, MP2, 702, 704 are PMOS transistors structured in the example current mirror 705. Accordingly, the current corresponding to the example reference current source 706 is mirrored and output to the example circuit 100. The first current terminals (e.g., source terminals) of the example transistors 702, 704 are coupled to the IC power pin 708 via a supply rail terminal of the current mirror 705. The second current terminal (e.g., drain terminal) of the example transistor MP1 702 (e.g., the input terminal of the current mirror 705) is coupled to the example reference current source 706 and the second current terminal (e.g., drain terminal) of the example transistor MP2 704 (e.g., the output terminal of the current mirror 705) is coupled so the first example current terminal 106 of the example transistor M1 102 in the example circuit 100. The second example current terminal 108 of the example transistor M1 102 in the circuit 100 is coupled to the CC1 pin 710 of the USB Type-C device (e.g., directly or via a cable CC line).

The example transistors 702, 704 and the example reference current source 706 of FIG. 7 create a Type-C source pull up resistance used in the USB Type-C specification, which sends current to the example CC1 pin 710. However, if the Type-C device has a lower supply rail than the supply rail of a device coupled to the IC power pin 708 and reverse current is not blocked, the undesired reverse current may flow from the CC1 pin 710 to the IC pin 708. However, as described above in conjunction with FIGS. 1-3, the example circuit 100 blocks the undesired reverse current regardless of whether the transistor M1 106 is in depletion mode or enhancement mode. Accordingly, the transistor M1 106 may be implemented with a very low, or negative, threshold voltage to generate a low forward voltage drop while still blocking reverse current. The lower the voltage drop (e.g., the lower the threshold voltage), the less of an impact the circuit 100 has on the ability of the Type-C source to pull up a CC pin to requirements of the USB Type-C specification.

In the example of FIG. 7, the resistor R1 110 is coupled to the high rail of the example current mirror 705/the IC power pin 708 to connect to the highest potential in the circuit (e.g., the power rail that the circuit 100 protects from reverse current). However, the example resistor R1 110 may be coupled to the drain of the example transistor M1 102 (such as in FIG. 1).

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects and/or things, the phrase "at least one of A and B" is intended to refer to implementations including any of (1) at least one A, (2) at least one B, and (3) at least one A and at least one B. Similarly, as used herein in the context of describing structures, components, items, objects and/or things, the phrase "at least one of A or B" is intended to refer to implementations including any of (1) at least one A, (2) at least one B, and (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, and (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, and (3) at least one A and at least one B.

From the foregoing, it will be appreciated that example methods, apparatus, and articles of manufacture correct gate bias for a diode-connected transistor. Examples disclosed herein ensure that a diode-connected transistor operates as a diode to allow circuit in a first direction and block reverse current in a second direction opposite of the first direction regardless of whether the diode-connected transistor is operating in enhancement mode or depletion mode. In this manner, diode-connected transistors can be generated with small (e.g., even negative) threshold voltages corresponding to small forward voltage drops with a fewer, smaller, and more efficient components. Accordingly, examples disclosed herein provide an improvement to previous diode-connected transistors.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An integrated circuit comprising:

(a) a power input, a circuit ground, and an output terminal;

(b) a first transistor having a first current terminal coupled to the power input, having a gate, having a substrate terminal connected to the circuit ground, and having a second current terminal connected to the output terminal;

(c) a first resistor having a first terminal connected to the power input and having a second terminal connected to the gate of the first transistor;

(d) a second transistor having a first current terminal connected to the second terminal of the first resistor, having a gate connected to the circuit ground, having a substrate terminal connected to the circuit ground, and having a second current terminal; and (e) a second resistor having a first terminal connected to the second current terminal of the second transistor and having a second terminal connected to the circuit ground.

2. The integrated circuit of claim 1 including a USB-type C CC1 pin coupled to the output terminal.

3. The integrated circuit of claim 1 including:

a current mirror circuit having an input connected to the power input, having a current source terminal, and having an output connected to the first current terminal of the first transistor; and a current source having a first terminal connected to the current source terminal and having a second terminal connected to the circuit ground.

4. The integrated circuit of claim 3 in which the current mirror circuit includes:

a third transistor having a first current terminal connected to the power input, having a gate connected to the current source terminal, and having a second current terminal connected to the current source terminal.

5. The integrated circuit of claim 4 in which the third transistor is a p-channel field effect transistor.

6. The integrated circuit of claim 4 in which the current mirror includes:

a fourth transistor having a first current terminal connected to the power input, having a gate connected to the current source terminal, and having a second current terminal connected to the first current terminal of the first transistor.

7. The integrated circuit of claim 6 in which the fourth transistor is a p-channel field effect transistor.

8. The integrated circuit of claim 1 in which the first transistor is an n-channel field effect transistor.

9. The integrated circuit of claim 1 in which the second transistor is an n-channel field effect transistor.

10. The integrated circuit of claim 1 in which the first transistor has a first threshold voltage, the second transistor has a second threshold voltage, and the first threshold voltage and the second threshold voltage are substantially similar.

11. The integrated circuit of claim 1, in which the first transistor has a first threshold voltage, the second transistor has a second threshold voltage, and the first threshold voltage and the second threshold voltage are the same.

12. The integrated circuit of claim 1 in which the first transistor is a p-channel field effect transistor.

13. The integrated circuit of claim 1 in which the second transistor is a p-channel field effect transistor.

14. The integrated circuit of claim 1 in which the first current terminal of the first transistor is a drain and the second current terminal of the first transistor is a source.

15. The integrated circuit of claim 1 in which the first current terminal of the second transistor is a drain and the second current terminal of the second transistor is a source.

* * * * *